US009653278B2

(12) United States Patent
Guna

(10) Patent No.: US 9,653,278 B2
(45) Date of Patent: May 16, 2017

(54) DYNAMIC MULTIPOLE KINGDON ION TRAP

(71) Applicant: DH Technologies Development Pte. Ltd., Singapore (SG)

(72) Inventor: Mircea Guna, North York (CA)

(73) Assignee: DH Technologies Development Ptd. Ltd., Singapore (SG)

( * ) Notice: Subject to any disclaimer, the term of this patent is extended or adjusted under 35 U.S.C. 154(b) by 0 days.

(21) Appl. No.: 14/369,308

(22) PCT Filed: Nov. 28, 2012

(86) PCT No.: PCT/IB2012/002574

§ 371 (c)(1),
(2) Date: Jun. 27, 2014

(87) PCT Pub. No.: WO2013/098607

PCT Pub. Date: Jul. 4, 2013

(65) Prior Publication Data

US 2015/0008316 A1 Jan. 8, 2015

Related U.S. Application Data

(60) Provisional application No. 61/580,876, filed on Dec. 28, 2011.

(51) Int. Cl.

| | |
|---|---|
| ***H01J 49/26*** | (2006.01) |
| ***H01J 49/42*** | (2006.01) |
| ***H01J 49/10*** | (2006.01) |

(52) U.S. Cl.

CPC ..... *H01J 49/4225* (2013.01); *H01J 49/10* (2013.01); *H01J 49/26* (2013.01); *H01J 49/4255* (2013.01)

(58) Field of Classification Search

CPC ..... H01J 49/4225; H01J 49/26; H01J 49/10; H01J 49/4255

USPC ..... 250/281, 282, 283

See application file for complete search history.

(56) References Cited

U.S. PATENT DOCUMENTS

| | | | | |
|---|---|---|---|---|
| 2007/0164213 | A1 | 7/2007 | Javahery et al. | |
| 2010/0116982 | A1 | 5/2010 | Iwamoto et al. | |
| 2010/0176293 | A1 | 7/2010 | Wuest et al. | |
| 2012/0112056 | A1* | 5/2012 | Brucker et al. | 250/282 |
| 2013/0068942 | A1* | 3/2013 | Verenchikov | H01J 49/4245 250/282 |

FOREIGN PATENT DOCUMENTS

| | | |
|---|---|---|
| JP | 2008-130401 | 6/2008 |
| JP | 2008-192557 | 8/2008 |

OTHER PUBLICATIONS

International Search Report from International Patent Application No. PCT/IB2012/002574, dated Apr. 30, 2013.

* cited by examiner

*Primary Examiner* — Nicole Ippolito

(57) ABSTRACT

An ion trap is disclosed comprising a plurality of elongate electrodes aligned with one another and with a central longitudinal axis along respective longitudinal axes and that are spaced apart from one another and disposed about a central longitudinal axis to form a quadrupole. The ion trap further comprises an elongate electrode that is aligned with and disposed along the central longitudinal axis, and circuitry coupled to the outer electrodes is suitable for driving the central and outer electrodes to selectively trap of ions within a region defined between the central electrode and the outer.

9 Claims, 4 Drawing Sheets

DYNAMIC MULTIPOLE KINGDON ION TRAP

RELATED APPLICATION

This application claims priority to U.S. provisional application No. 61/580,876 filed Dec. 28, 2011, which is incorporated herein by reference in its entirety.

INTRODUCTION

The applicants' teachings pertain to analytic chemistry including mass spectrometry methods and apparatus.

Ion traps have found application in mass spectrometry, where the combination of electric fields imposed, for example, by Paul-type ion traps, have proven beneficial in improving selection (or filtering) of analyte ions at all stages of processing. In this style of trap, ions of a designated mass-to-charge ratio (or range) are maintained within and selectively released from a chamber by a combination of direct current (DC) and alternating current (AC) fields from hyperbolic end caps and ring electrodes, in a 3-dD Paul trap, and raidallly or axially in a linear quadrupole ion trap. In the dynamic Kingdon-type trap, the electrostatic and electodynamic fields are generated by RF and DC fields applied to an axial quadrupole and a centrally disposed wire. In practice a variant of the electrostatic Kingdon trap, namely, the Orbitrap has found favor.

SUMMARY

The applicants' teachings provide, in some aspects, an ion trap that comprises a plurality of elongate electrodes ("outer electrodes") that are aligned with one another and with a central longitudinal axis along respective longitudinal axes and that are spaced apart from one another and disposed about a central longitudinal axis to form a quadrupole. The ion trap further comprises an elongate electrode ("central electrode") that is aligned with and disposed along the central longitudinal axis.

Circuitry coupled to the outer electrodes is suitable for driving the central and outer electrodes so as to selectively trap ions within a region defined between the central electrode and the outer electrodes by applying to the outer electrodes an RF-varying potential such that each pair of outer electrodes disposed opposite one another vis-a-vis the central longitudinal axis is at an RF-varying potential to each other pair of outer electrodes disposed opposite one another vis-a-vis that axis. That circuitry is also coupled to the central electrode and applies to it at least one of a DC potential and an RF-varying potential.

Related aspects of the invention provide ion trap, e.g., as described above, that further comprises at least one of an ion inlet and an ion outlet whence ions can be admitted or permitted to exit the region. One or both of the inlet and outlet can be, according to related aspects, grid lenses. And, in still further related aspects, the circuitry can be coupled to those lens(es) to apply any of a DC potential and an RF-varying potential to it (them).

Related aspects of the invention provide ion trap as described above in which each outer electrode of each pair of outer electrodes disposed opposite one another vis-a-vis the central longitudinal axis are electrically connected to one another and are at the same potential as one another.

Other aspects of the invention provide ion trap, e.g., as described above, in which the one or more of the outer electrodes are rod-shaped and/or in which the inner electrode comprises a wire.

The applicants' teachings provide, in other aspects, mass spectrometry apparatus comprising one or more ion traps of the type described above that are coupled in an ion flow path. Related aspects provide such apparatus in which a plurality of such ion traps are configured to selectively trap ions of different respective mass-to-charge ratios.

Further aspects of applicants' teaching provide methods for operating ion traps and/or mass spectrometry apparatus of the type described above.

BRIEF DESCRIPTION OF THE DRAWINGS

A more complete understanding of the invention may be attained by reference to the drawings, in which.

DESCRIPTION OF VARIOUS EMBODIMENTS

Figure 1:
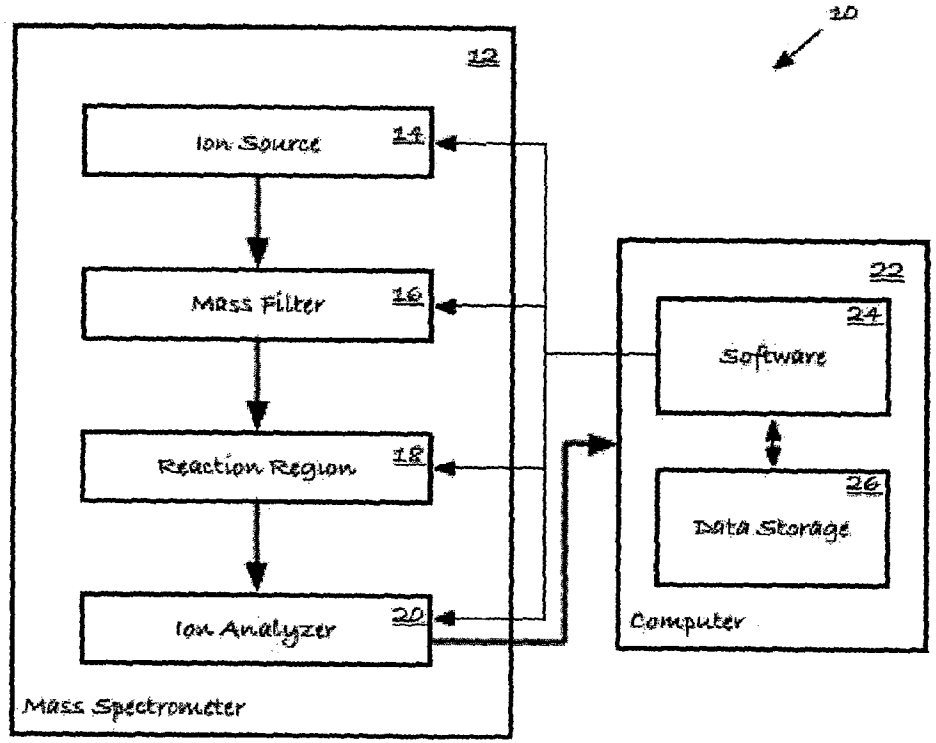
FIG. 1 depicts a mass spectrometry system of the type with which an ion trap in accordance with applicants' teachings may be incorporated.

FIG. 1 depicts a mass spectrometry system 10 of the type with which an ion trap in accordance with applicants' teachings may be incorporated. The system 10 comprises mass spectrometer 12—itself comprising an ion source 14, a mass filter 16, a reaction region 18, and an ion analyzer 20 that are coupled to form a flow-path for the processing and analysis of ions in accord with the teachings hereof. The system further comprises a digital data processor 22 that is electronically coupled with the spectrometer 12 and that comprises software 24 and data storage unit 26.

Although the spectrometer 12 and computer 22 are each shown, here, as separate units housing respective constituent components, in some embodiments those components may be housed otherwise. Thus, for example, the computer 22 (or one or more components thereof) may be housed with the spectrometer 12, one or more components of the spectrometer may comprise stand-alone equipment, and so forth—all by way of example. For these reasons, among others, the terms "apparatus" and "systems" are used interchangeably herein.

The ion source 14 is configured to emit ions generated from the analyte or sample (not shown) to be analyzed. The ion source is constructed and operated (e.g., by a human operator, computer 22, and/or otherwise) in the conventional manner known in the art of mass spectrometry, as adapted in accord with the teachings hereof. The ion source can comprise, but is not limited to, a continuous ion source, such as an electron impact (EI), chemical ionization (CI), or field desorption-ionization (FD/I) ion sources (which may be used in conjunction with a gas chromatography source); an electrospray (ESI) or atmospheric pressure chemical ionization (APCI) ion source (which may be used in conjunction with a liquid chromatography source); a desorption electrospray ionization (DESI); or a laser desorption ionization source such as a matrix assisted laser desorption ionization (MALDI), laser desorption-ionization (LDI) or laserspray (which typically utilizes a series of pulses to emit a pulsed beam of ions).

Ions generated by the ion source are transmitted to mass filter 16, which is configured to select (or filter) a subset of ions within a chosen mass-to-charge ratio range and/or based on intensity of the analyte ions for transmission into the reaction region 18. The mass filter is constructed and operated (e.g., by a human operator, computer 22, and/or otherwise) in the conventional manner known in the art, as adapted in accord with the teachings hereof. The mass filter can comprise, but is not limited to, a quadrupole mass filter, an ion trapping device (such as a 3D or 2D quadrupole ion trap, a C-trap, or an electrostatic ion trap), all by way of example.

Ions emitted by the mass filter 16 are admitted into the region 18 for dissociation by reaction with a reagent gas or gas mixture under a prescribed pressure. The mass filter is constructed and operated (e.g., by a human operator, computer 22, and/or otherwise) in the conventional manner known in the art, as adapted in accord with the teachings hereof. The reaction region 18 can comprise, but is not limited to, a quadrupole mass filter, an ion trapping device (such as a 3D or 2D quadrupole ion trap, a C-trap, or an electrostatic ion trap), all by way of example.

The ion analyzer 20 is positioned downstream of the ion source and the reaction region in the path of the ions emitted from reaction region 18. Analyzer 20, which may comprise a detector (not shown) separates the emitted ions and fragments as a function of mass-to-charge ratio (m/z) and generates an output representing counts at or around a designated m/z value. The ion analyzer (and constituent detector) is constructed and operated (e.g., by a human operator, computer 22, and/or otherwise) in the conventional manner known in the art, as adapted in accord with the teachings hereof. The mass analyzer can comprise, but is not limited to a quadrupole mass filter, an ion trapping device (such as a 3D or 2D quadrupole ion trap, a C-trap, or an electrostatic ion trap), an ion cyclotron resonance trap, an Orbitrap, or a time-of-flight mass spectrometer, all by way of example.

Components 14-20 of the spectrometer 12 are coupled by tubing, valves and other apparatus of the type conventionally used in the art to form an flow path suitable for passage and analysis of ions generated by source 14 in accord with the teachings hereof.

Computer 22 comprises a general- or special-purpose digital data processor (stand-alone, embedded or otherwise) of the type known in the art suitable for controlling and/or providing an interface to spectrometer 12, all in the conventional manner known in the art, as adapted in accord with the teachings hereof. Thus, for example, software 24 executes on computer 22 in order to facilitate and/or effect operation of spectrometer consistent with the teachings hereof, and data storage 26 retains one or more databases reflecting the molecular structure of analytes and/or their expected fragmentation locations, as well as of mass-to-charge ratios of the respective fragments thereof.

Figure 2:
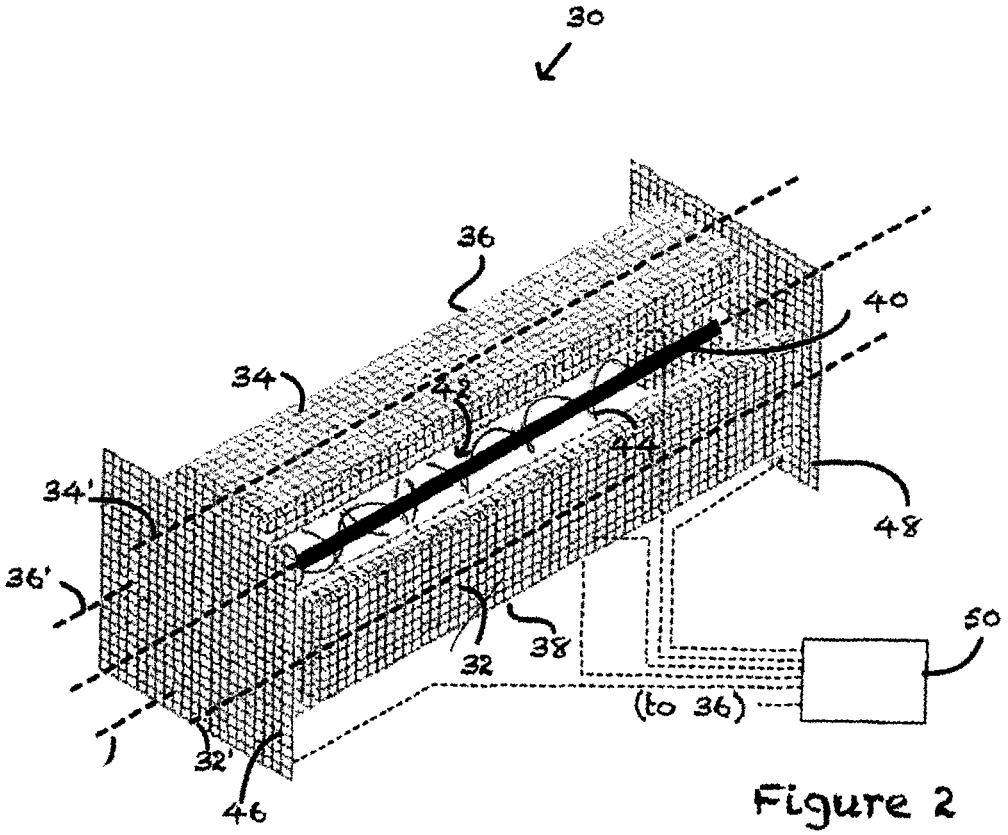
FIG. 2 schematically depicts an ion trap according to applicants' teachings that comprises a four of elongate electrodes that are arranged to form a quadrupole.

In addition to and/or instead of the exemplary components discussed above, one or more of the mass filter 16, reaction chamber 18 and ion analyzer 20 comprise an ion trap as shown in FIG. 2, et seq. and discussed below.

FIG. 2 schematically depicts an ion trap 30 according to applicants' teachings that comprises a set four elongate electrodes ("outer electrodes") 32-38 that are arranged to form a quadrupole. Thus, they are spaced apart from one another and disposed about a central longitudinal axis 30'. Those electrodes are, as well, aligned with one another along respective longitudinal axes 32'-38' and with the axis 30', as shown. In the illustrated embodiment, the respective axes 30' and 32'-38' are aligned insofar as they are parallel with one another or substantially so. Only two of the elongate outer electrodes are shown in the drawing; the others are hidden in the perspective drawing.

Outer electrodes 32-38 of the illustrated embodiment are of circular cross-section. However, in other embodiments of applicants' teachings, the electrodes may have rectangular hyperbolic or other cross sections.

Illustrated ion trap 30 also comprises an elongate electrode ("central electrode"), here, a wire 40 (though, in other embodiments, or other rod-shaped or elongate conductor) that, too, is aligned with and disposed along the central longitudinal axis 30'. In the drawing, the central electrode 40 has a length along its longitudinal axis equal or substantially equal to respective lengths of outer electrodes 32-38 along their respective longitudinal axes 32'-38'. In other embodiments, the electrode 40 can be shorter (or longer) than the outer electrodes along those axes.

As those skilled in the art will appreciate, the region 42 between the central electrode 40 and the outer electrodes 32-38 can selectively trap ions or ion fragments, as indicated here by spiraling ion path 44, when driven with applied radio frequency (RF) and/or direct current (DC) voltages in view of the teachings hereof. To this end, the region is further defined by end caps 46, 48, which can serve as an inlet and outlet (collectively, "ports") for such ions or ion fragments (hereinafter, collectively referred to as "ions" for convenience), whence ions can be admitted or permitted to exit the trap region. In the illustrated embodiment, these end caps comprise grids that can be selectively charged to permit (if not encourage) the pass-through of ions or, alternatively, to prevent such passage (e.g., by repelling nearby ions) and, as such, are referred to elsewhere herein as "grid lenses."

In some embodiments of applicants' teachings, the grid lens 46 that comprises the ion inlet is configured to improve trapping of incoming ions by insuring that they are introduced into the region spatially offset from the central electrode 40 and/or with a velocity vector other than one aligned with the electrode 40 and the axis 30'.

Illustrated circuitry 50 which can, for example, operate under control of computer 22, is connected to the outer electrodes 32-38, the central electrode 40 and the end caps/ports 44, 46, driving them at radio frequency (RF) and/or direct current (DC) potentials as discussed below in order to effect a selective ion trap within the region 42. Generally speaking, in some embodiments, the circuitry effects this by applying to the outer electrodes 32-38 an RF-varying potential such that each pair of outer electrodes disposed opposite one another vis-a-vis the central longitudinal axis 30' (e.g., pair 32/36) is at an RF-varying potential to each other pair of outer electrodes disposed opposite one another vis-a-vis that axis (e.g., pair 34/38). Moreover, the circuitry ensures that the electrodes of each pair, e.g., electrodes 32, 36 of pair 32/36, are at the same potential as one another. The circuitry 50 can, in addition, apply a DC potential to each pair, e.g., 32/36 and 34/38, as further discussed below. Circuitry 50 similarly applies RF-varying potentials and/or DC potentials to ports 46, 48 and to central electrode 40, also as discussed below.

By way of example, in some embodiments, the circuitry 50 applies RF voltages to electrodes 32-38 in accordance with the following relations:

$$V_{RF}=V_{rf}\cos(\Omega t)\text{(applied to electrodes 32,36)}$$

$$V_{RF}=-V_{rf}\cos(\Omega t)\text{(applied to electrodes 34,38)}$$

where, $V_{RF}$ denotes the time-dependent RF voltage, $V_{rf}$ denotes the amplitude of the RF voltage, and $\Omega$ denotes the angular frequency of the RF voltage.

More generally, the circuitry 50 applies to outer electrodes 32-38, central electrode 40 RF and DC voltages selected such that ions having mass-to-charge ratios in a desired range can have stable trajectories about the central electrode 40 and, hence, are trapped in region 42, while ions having other mass-to-charge ratios have unstable trajectories and, hence, are discharged by the central electrode 40 and/or outer electrodes 32-38. The circuitry 50 can, moreover, in some embodiments, apply different potentials to the various electrodes 32-40 and end caps 46, 48 at different times, e.g., by gradual ramping, by discrete changes, or otherwise, to obtain a differential stability of ions in the region 42 based on mass-to-charge ratio.

In addition, the circuitry 50 can apply voltages to those end caps 46, 48 causing them to selectively open as ports and, thereby, to permit (if not, also, to encourage via application of attractive and/or repulsive potentials) the passage of ions, e.g., into the region 42 in the case of end cap/port 46 or out of the region 42 in the case of end cap/port 48. In embodiments in which the ion trap 30 forms part of spectrometer 12, and depending in the configuration thereof, such passage can be, for example, into the region 42, e.g., from upstream apparatus, such as ion source 14, and from region 42 to exit into downstream apparatus, e.g., reaction chamber 18. By way of example, the circuitry 50 can modify the voltage on the end caps 46, 48 to cause them to open or shut as ports. The voltage applied to the exit lens 46 is dropped to a value that would create a potential drop and force the ions to exit the trap through the exit lens.

Figure 3A:
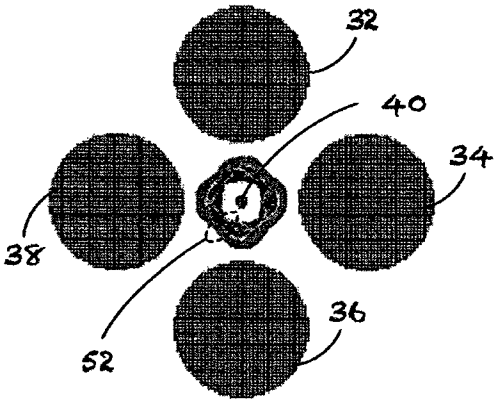
FIGS. 3A-3C depict results of operation of a theoretically simulated ion trap according to applicants' teachings.
Figure 3B:
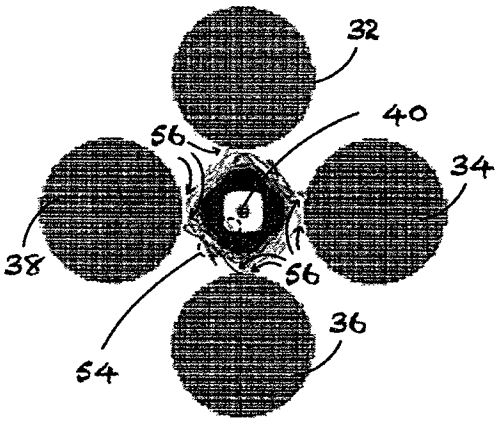
Figure 3C:
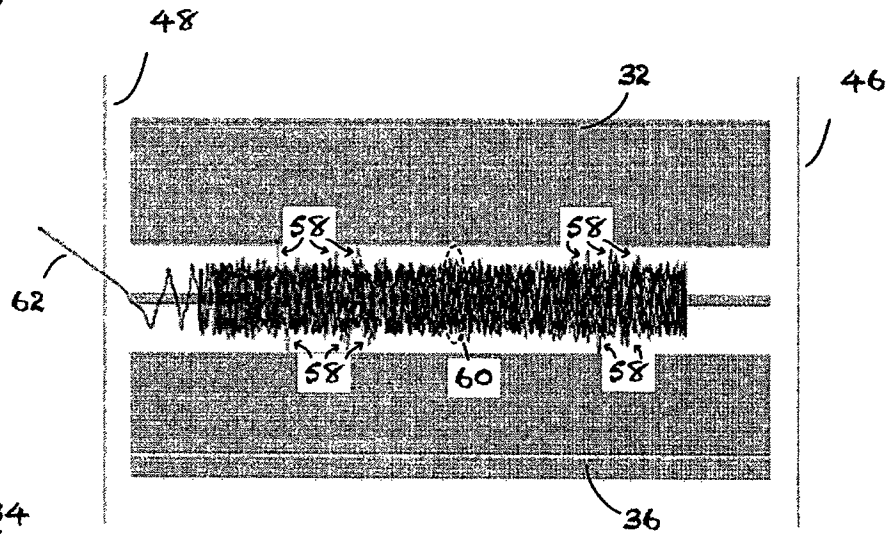

By way of an example, which should not be construed as limiting the scope of the applicant's teachings in any way, the behavior of three types of ions having mass-to-charge ratio values of 1000 Da, 1100 Da and 1200 Da, respectively, was theoretically simulated in an ion trap as described above. The results are shown in FIGS. 3A-3C.

In the simulation, the RF and DC voltages were initially selected as follows so that all the three types of ions would have stable trajectories within the trap (that is, all ions were initially trapped), as shown in a radial cross-section of the ion trap 30 by paths 52 of

FIG. 3A:

RF frequency=1 MHz;

$V_{rf}$(RF amplitude): 920 volts (V);

DC voltage on all quadrupole rods=−160 V;

DC voltage on central filament=−250 V;

DC voltages on the entrance and exit lenses=0 V.

Referring to FIG. 3B, the RF amplitude was then increased to 1020 V to render the trajectories of the ions with mass-to-charge ratio of 1000 Da unstable while retaining the other ions in their stable trajectories. See, paths 54 shown in radial cross-section in FIG. 3B shown stable trajectories and paths 56 showing neutralization via impact with the outer electrodes 32-38 of ions with unstable trajectories.

Referring to FIG. 3C, showing a longitudinal cross-section of the trap 30, the RF amplitude in the simulation was again increased from 1020 V to 1120 V to render unstable the trajectories of the ions with mass-to-charge ratio of 1100 Da as well, while retaining the ions with an mass-to-charge ratio of 1200 Da within stable trajectories. As seen in that drawing, at this RF voltage, ions having mass-to-charge ratios of 1000 Da and 1100 Da do not follow stable trajectories, and hence are neutralized by the quadrupole rods, as shown by paths 58. The 1200 mass-to-charge ratio ions, however, remain trapped by continuing to follow stable trajectories, as shown by paths 60.

FIG. 3C also shows the effect of modifying the potentials applied to the end caps 46, 48 and, particularly, in this instances, the end cap 48 that serves as an outlet port of the trapping region 32. Particularly, as evidenced by path 62, ions having a 1200 mass-to-charge ratio can be ejected from the chamber for further processing by downstream apparatus by adjusting the potential on the exit lens to −170V.

In view of the example above, it will be appreciated that apparatus according to the applicants' teachings can be employed to selectively eliminate ions of different mass-to-charge ratios, e.g., via neutralization by the quadrupole outer electrodes, while ions of interest remain stably trapped, e.g., for eventual discharge from the trap 30.

In some uses of trap 30, ions generated by other apparatus, e.g., ion source 14, are be introduced into the trap 30 via the inlet port 46 as described above. Alternatively or in addition the trap can be used to form in situ ions, e.g., from neutral molecules introduced into the region or from other ions. Such in situ ionization may be achieved in a variety of different ways, for example, via electron impact (EI) or UV (ultraviolet) laser radiation, collision induced dissociation (CID), electron capture dissociation (ECD) or electron transfer dissociation (ETD), and so forth, to name a few. In these and other instances, ions or at least a portion thereof having mass-to-charge ratios within a desired range, can be trapped in stable trajectories about the electrode 40 via the applied RF and DC voltages, as described above. And, in some cases, the amplitude of potentials applied by the circuitry 50 to the electrodes can be adjusted to retain those generated ions which are of interest in stable trajectories while rendering the trajectories of other ions, such as impurity ions, unstable so that they are neutralized via impact with the electrodes of the trap 30.

Figure 4:
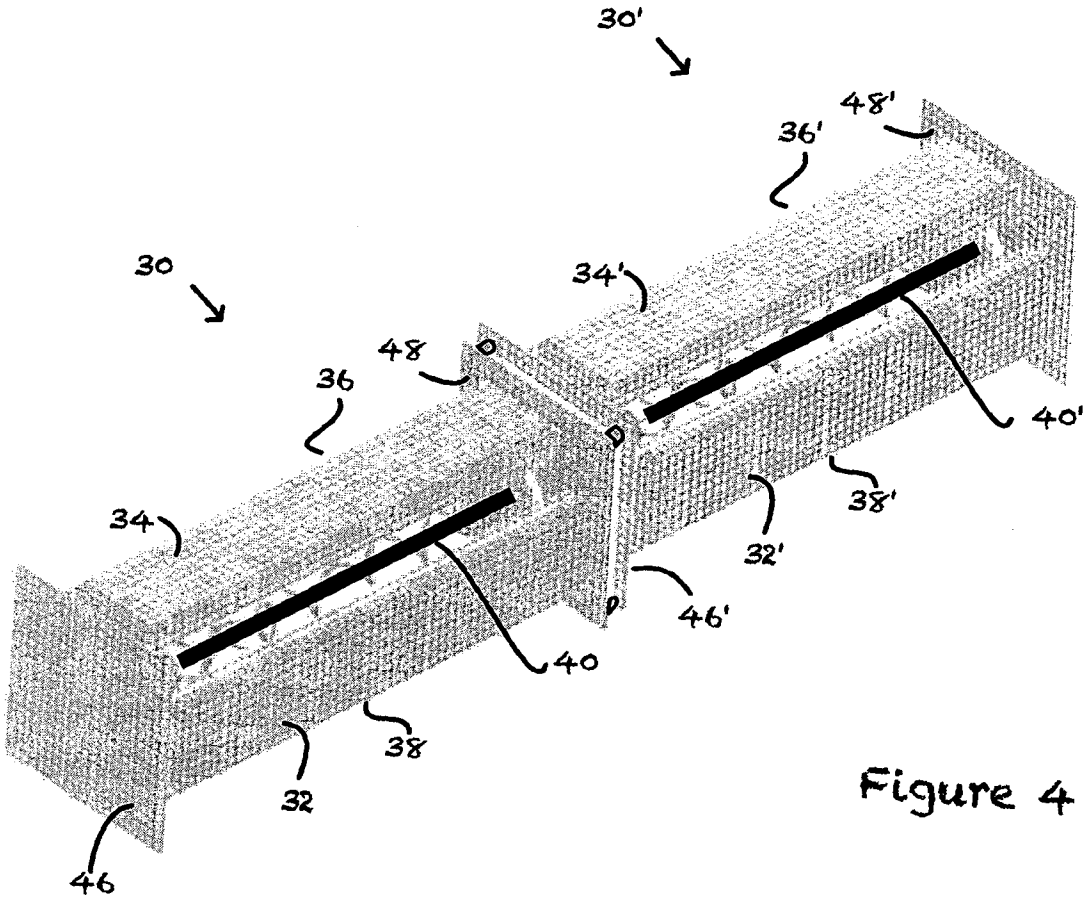
FIG. 4 depicts a multi-sectioned ion trap according to the invention comprising a plurality of sections, each made up of an ion trap of the type shown in FIG. 2.

An ion trap 64 according to applicants' teachings can be multi-sectioned. Such a multi-sectioned ion trap is shown in FIG. 4, with sections 30 and 30', both constructed and operated in the manner of ion trap 30 above and separated by one another by insulation spaces 66. The electrodes and end caps/ports of each such section can be driven with RF and/or DC potentials by circuitry of the type described above in connection with element 50 in order to effect admittance, trapping, creation, destruction and/or expulsion of ions in the respective trapping regions 42, 42' of those sections 30, 30'. The application of potentials to those sections, moreover, can be coordinated, e.g., by computer 22, in order to effect desired sequential processing, segregation, filtering and/or other processing of ions, e.g., such that each such section electively trap ions of different respective mass-to-charge ratios.

Described above are embodiments of applicants' teachings. It will be appreciated that these are merely examples and that other embodiments fall within the scope thereof. Thus, for example, although FIG. 4 shows just sections of a multi-sectioned ion trap, applicants' teachings also contemplate three or more sections.

The invention claimed is:

1. A linear ion trap, comprising:

a. a plurality of elongate electrodes ("outer electrodes"), each having a longitudinal axis that is aligned with a central longitudinal axis, the plurality of elongate electrodes being spaced apart from one another and disposed about that central longitudinal axis to form a quadrupole;

b. an elongate electrode ("central electrode") that is aligned with and disposed along the central longitudinal axis and positioned between the plurality of elongate electrodes that form a quadrupole; and c. circuitry coupled to the outer electrodes suitable for driving the central electrode and the plurality of outer electrodes so as to selectively trap ions within a region defined between the central electrode and the outer electrodes, the ions around the central electrode, by applying (i) to the outer electrodes an RF-varying potential such that each pair of outer electrodes disposed opposite one another vis-a-vis the central longitudinal axis is at an RF-varying potential to each other pair of outer electrodes disposed opposite one another vis-a-vis that axis, and (ii) to the central electrode at least one of a DC voltage and an RF-varying voltage.

2. The ion trap of claim 1, comprising at least one of an ion inlet and an ion outlet.

3. The ion trap of claim 2, wherein at least one of the ion inlet and the ion outlet are grid lenses.

4. The ion trap of claim 3, wherein the circuitry is coupled to at least one of said grid lenses and applies thereto any of a DC potential and an RF-varying potential.

5. The ion trap of claim 1, wherein each outer electrode of each pair of outer electrodes disposed opposite one another vis-a-vis the central longitudinal axis are at the same potential as one another.

6. The ion trap of claim 1, in which the one or more of the outer electrodes are rod-shaped.

7. The ion trap of claim 1, in which the inner electrode comprises a wire.

8. A mass spectrometer comprising one or more linear ion traps, each comprising:

a. a plurality of elongate electrodes ("outer electrodes"), each having a longitudinal axis that is aligned with a central longitudinal axis, the plurality of elongate electrodes being spaced apart from one another and disposed about that central longitudinal axis to form a quadrupole;

b. an elongate electrode ("central electrode") that is aligned with and disposed along the central longitudinal axis and positioned between the plurality of elongate electrodes that form a quadrupole;

c. circuitry coupled to the outer electrodes suitable for driving the central electrode and the plurality of outer electrodes so as to selectively trap of ions within a region defined between the central electrode and the outer electrodes, the ions around the central electrode; and d. wherein the circuitry can selectively trap such ions by applying (i) to the outer electrodes an RF-varying potential such that each pair of outer electrodes disposed opposite one another vis-a-vis the central longitudinal axis is at an RF-varying potential to each other pair of outer electrodes disposed opposite one another vis-a-vis that axis, and (ii) to the central electrode at least one of a DC voltage and an RF-varying voltage.

9. A method of trapping ions in a linear ion trap, comprising:

a. providing a plurality of elongate electrodes ("outer electrodes"), each having a longitudinal axis that is aligned with a central longitudinal axis, the plurality of elongate electrodes being spaced apart from one another and disposed about that central longitudinal axis to form a quadrupole;

b. providing an elongate electrode ("central electrode") that is aligned with and disposed along the central longitudinal axis and positioned between the plurality of elongate electrodes that form a quadrupole;

c. driving the central electrode and the plurality of outer electrodes so as to selectively trap of ions within a region defined between the central electrode and the outer electrodes, the ions around the central electrode; and d. wherein the driving step is effected by applying (i) to the outer electrodes an RF-varying potential such that each pair of outer electrodes disposed opposite one another vis-a-vis the central longitudinal axis is at an RF-varying potential to each other pair of outer electrodes disposed opposite one another vis-a-vis that axis, and (ii) to the central electrode at least one of a DC voltage and an RF-varying voltage.

* * * * *